United States Patent [19]

Long et al.

[11] 4,361,736

[45] Nov. 30, 1982

[54] PRESSURE RECORDING PROCESS AND DEVICE

[76] Inventors: Edward M. Long, 4107 Oakmore Rd., Oakland, Calif. 94602; Ronald J. Wickersham, 694 Mt. View Ave., Santa Rosa, Calif. 95401

[21] Appl. No.: 101,113

[22] Filed: Dec. 7, 1979

[51] Int. Cl.[3] ..... H04R 1/20

[52] U.S. Cl. ..... 179/121 R; 179/1 MF; 179/147; 179/148 R; 181/155

[58] Field of Search ..... 179/1 AT, 1 MF, 121 R, 179/121 D, 146 R, 147, 148 R, 148 F, 152, 154; 181/155, 175, 296

[56] References Cited

U.S. PATENT DOCUMENTS

| | | | |
|---|---|---|---|
| 2,267,353 | 12/1941 | Lakhovsky | 181/175 |
| 2,544,536 | 3/1951 | Kettler | 179/1 MF |
| 2,577,288 | 12/1951 | Terlinde | 179/146 R |
| 3,496,297 | 2/1970 | Brumberger | 179/146 R |
| 3,870,820 | 3/1975 | Suzuki et al. | 179/121 D |

*Primary Examiner*—George G. Stellar

*Attorney, Agent, or Firm*—Manfred M. Warren; Robert B. Chickering; Glen R. Grunewald

[57] ABSTRACT

A process for transducing acoustical signals, including music, speech, noise, etc. which embodies a method which eliminates the usual discrimination between the frequency spectra of the direct and random incidence acoustical components of the sound being transduced and allows the frequency range of interest to be controlled by adjusting the spacing between the diaphragm or major entry port of an acoustical to electrical transducer and a boundary. The invention requires that the diaphragm or major entry port of the transducer be oriented substantially parallel with and proximate to a boundary. A formula is disclosed by which the proximate relationships between the diaphragm and a boundary can be determined for any desired frequency range, which eliminates the discrimination between the frequency spectra of the direct and random incidence acoustical signals on the transducer while allowing the rejection, at the transducer, of unwanted higher frequency acoustical signals, by means of acoustical cancellation, which causes a filtering action without the undesirable effects of non-uniform phase or group delay caused by high order, sharp cut-off filters normally employed to reject these higher frequency signals.

In the device, an acoustical-to-electrical transducer, having a uniform pressure versus frequency characteristic in the desired frequency range, is mounted with its diaphragm substantially parallel with and proximate to a surface forming part of a boundary and supported by a structure which is adjustable, or fixed during manufacture, to control the proximate distance between the diaphragm and its substantially parallel boundary. A surface connected to the adjustable or fixed structure, which forms part of a boundary, can also be used when it is only slightly raised from the boundary by shock mountings to mechanically isolate it from the boundary under which circumstances it functions as part of the larger substantially parallel boundary.

5 Claims, 5 Drawing Figures

PRESSURE RECORDING PROCESS AND DEVICE

BACKGROUND

In the past a major problem encountered in attempting to make realistic recordings or accurate acoustical measurements has been the discrimination by the microphone between the frequency spectra of the direct and random incidence (diffuse field) acoustical pressure variations. This discrimination is caused by the physical dimensions of the microphone as compared to the shortest wavelength of interest. Since even a microphone with a diaphragm as small as 0.5 inches (1.27 cm) in diameter will appear as an obstruction to a plane wave acoustical radiation because its diameter is one-half the wavelength at 13,560 Hertz, a pressure build-up will occur at the face of the diaphragm to zero degree incidence, acoustical pressure variations beginning at frequencies lower than 13,560 Hertz. This causes the pressure to increase at these higher frequencies and therefore a greater electrical output is produced at the microphone output terminals. This effect is shown in FIG. 1 in curve 1A. This build-up of pressure at the microphone diaphragm does not, however, occur for random incidence (diffuse field) acoustical pressure variations; see FIG. 1, curve 1B. Therefore, these is caused to be discrimination between zero degree, incidence and the random incident (diffuse field) acoustical pressure variations, as a result of physical presence of the microphone in the acoustical field it is attempting to sample.

To overcome the pressure increase at higher frequencies due to a microphone's physical dimensions, microphone designers have taken this into account and have designed conventional microphones to produce a flat characteristic response for zero degree incidence plane acoustical waves; see FIG. 1, curve 1C. But the response of such microphones to random incidence acoustical signals necessarily shows a decrease in output at the higher frequencies; see FIG. 1, curve 1D. Conventional microphones are designed to be used with their diaphragms or major entry ports aimed directly toward, or in the general direction of, the source. Since these conventional microphones discriminate between the zero degree incidence and random incidence acoustical signals, the direct sound and random incidence sound will exhibit different output versus frequency characteristics. This means that an unnatural spectral balance between acoustical signals arriving at the microphone from different directions, or between the direct and reverberant sound, will exist in the electrical output from such microphones; see FIG. 2, curves A through D.

FIG. 2A shows the amplitude vs. frequency response of a normal free field type microphone for zero degree incidence, plane wave sound. FIG. 2B shows the amplitude vs. frequency response of this same microphone for random incidence or reverberant sound. FIG. 2C is the amplitude vs. frequency characteristic for a typical reverberant environment and is included only for completeness in describing all of the factors which contribute to the spectral balance of the composite sound. FIG. 2D is the spectral balance of the final, composite sound as picked up and transduced into an electrical analog signal by a conventional free field type microphone, and is the result of the combination of effects shown in FIGS. 2A, B, and C. The effect upon the final spectral balance of the signal caused by the environment and shown in FIG. 2C is not part of the problem since it exists in the natural environment. It is not an object of this invention to place any restriction on the effects upon the spectral balance caused by the natural environment. It is an object of this invention, however, to allow the effects of the environment upon the spectral balance of the acoustical signal at the microphone position, to be transduced accurately and without the ambiguity heretofore caused by previous microphone techniques or methods.

It is an object of this invention to provide a process and microphone arrangement which overcomes this problem, by causing the microphone to respond without discrimination, with respect to its spectral content, to the direct and random incidence sounds arriving at the position of the microphone within the frequency range of interest.

It is also an object of this invention to provide a process and microphone arrangement which allows acoustical filtering in order to cancel undesired signals whose frequencies are above the band of interest. This acoustical filtering is caused by the interaction of the direct and reflected signals and therefore a sharp cut-off characteristic is achieved without the deleterious phase shift and non-uniform group delay of the equivalent high-order electrical wave filters.

It also eliminates the adverse effect upon spectral balance, due to the cancellation and addition effects, caused by the reflections from the adjacent boundary, proximate to the microphone, when using conventional microphone placements. Because such conventional microphone placements are usually at a moderate distance from boundaries, wavelength-dependent cancellations and additions will result from the interaction between the direct sound and the reflected sound from the nearby boundary. Placing a microphone close to a boundary with its diaphragm, or major entry port, perpendicular to the boundary does not completely ameliorate this latter problem since it merely moves the frequency of the first cancellation to a higher frequency, which is still within the audible spectrum. Such placement results in an uneven distribution of pressure across the diaphragm, which is wavelength-dependent; see FIG. 3. In FIG. 3, responses F1, G1, and H1 are computer-derived results for the combination of the direct and reflected sound at 1/16", 5/16", and 9/16" above the boundary respectively. An actual measured response is also shown which is the composite result of the combination of the direct and reflected sound at all distances between 1/16" and 9/16" above the boundary.

It is an object of this invention to allow the frequency of the first cancellation to be moved to an upper frequency, by controlling the distance between the boundary and the diaphragm or major entry port, which is determined by the process formula. At least two other benefits are derived from the use of the invention, which are (1) an increase in the practical sensitivity of the microphone approaching the theoretical maximum improvement of 6 dB, and (2) an increase in the practical signal-to-noise ratio approaching the theoretical maximum improvement of 6 dB.

SUMMARY OF THE INVENTION

This invention relates generally to the transducing of acoustical signals and applies to the recording and/or transmission of music, speech and sound effects for normal playback through loudspeakers and/or headphones as well as transducing of acoustical signals for measurement purposes. Such applications include, but are not limited to, the recording and/or transmission of sounds in auditoria, theaters, meeting rooms, studios and out-of-doors; the measurement of acoustical parameters in the types of environments listed above so that appropriate corrections can be made in such environments; the measurement of acoustical noise signals in various environments such as offices and factories; the measurement of acoustical noise due to vehicular traffic or aircraft fly-over.

The process described herein allows the transducing of acoustical signals with predictable resuls by using the process formula in conjunction with other details described. Problems overcome by this recording process are (1) the discrimination between the frequency spectra of the direct and random incidence sound waves within the frequency range of interest, (2) the lack of ability to reject, at the microphone, unwanted high frequency acoustical signals above the range of interest, and (3) problems associated with the use of high order, sharp cut-off filters normally employed to reject unwanted high frequency signals, and therefore the phase or group delay non-uniformity caused by such filters.

Acoustical signals are transduced by a process, according to this invention, which includes placing the diaphragm or major entry port of a microphone substantially parallel and proximate to a major boundary and adjusting the spacing between the diaphragm and the boundary to achieve a more natural spectral balance in a sound recording and/or transmission or acoustical measurement made from the output of the microphone.

DESCRIPTION OF THE DRAWINGS

The invention will be better understood by reading the specification in conjunction with the appended drawings, wherein.

DESCRIPTION OF THE INVENTION

Figure 1:
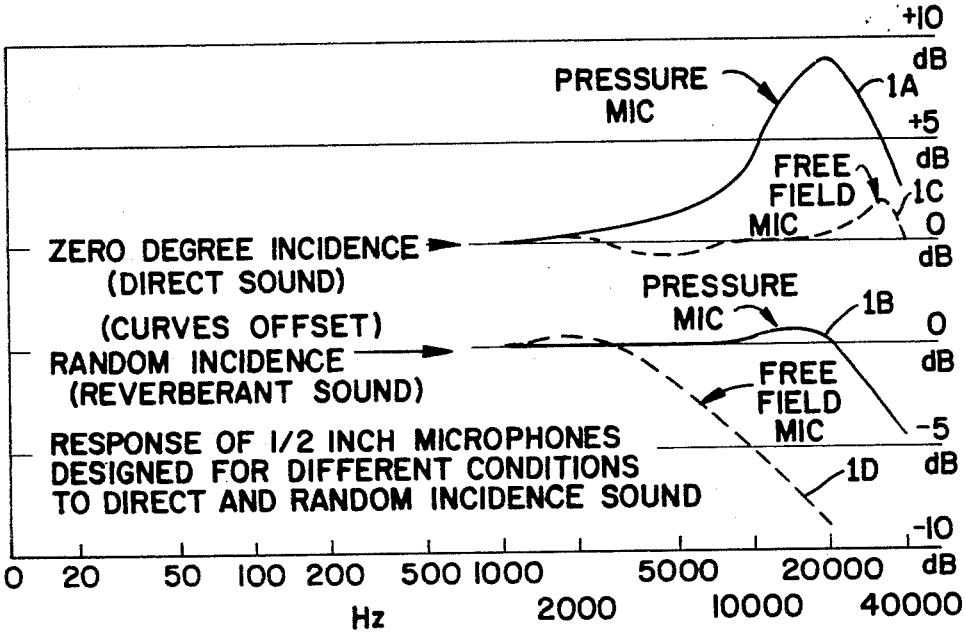
FIG. 1 is a graph showing the amplitude vs. frequency response of two different types of microphones with one-half inch diameter diaphragms with relationship to two different types of sound incidence.
Figure 2:
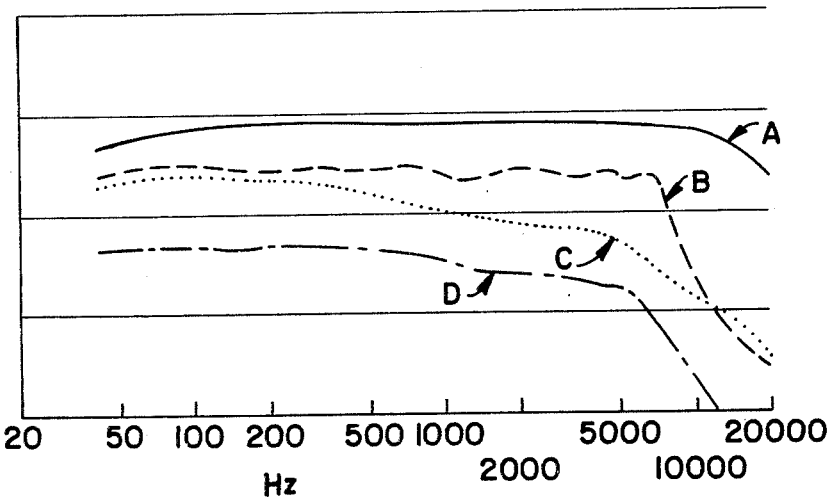
FIG. 2 is a graph showing amplitude versus frequency curves for a normal recording situation (prior art) wherein curve A is the response of a conventional microphone to zero degree sound, curve B is its response to random incidence sound, curve C is the typical spectral characteristics and curve D is the spectral balance of the electrical analog output signal due to effects of characteristic of curves A, B, and C.
Figure 3:
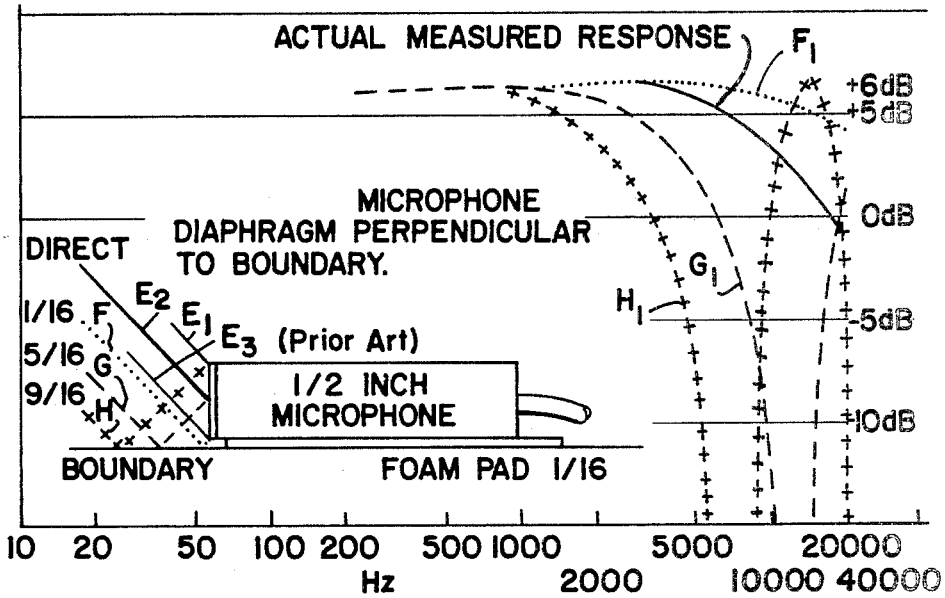
FIG. 3 is a graph illustrating measured response of signals received by a microphone with its diaphragm perpendicular and proximate to a boundary (prior art) as a function of frequency.

To practice the invention, a flat pressure versus frequency type microphone or microphone with a smooth high frequency roll-off which may be electrically corrected for flat response, is placed with its diaphragm, or major entry port, substantially parallel with and proximate to a boundary, which is preferably a first order boundary, proximate to the source. The required frequency range upper limit is determined, using the formula to derive the correct spacing. Thus, the microphone will respond so that the acoustical pressure variations from both the direct and random incidence acoustical signals are transduced without discrimination, as to spectral balance, up to a high frequency which is computed by the formula for any diaphragm to boundary spacing. This is due to the fact that the microphone is operated in a mode due to this spacing which senses only the variation in acoustical pressure and cannot discriminate with respect to the direction or angle of incidence of the sound to the highest frequency in the range of interest. In order for the spacing between the boundary and the microphone diaphragm to accomplish its objectives, it is necessary that all acoustic signals approach the diaphragm from the space between the boundary and the diaphragm, or alternatively, from the space between the boundary and the entry port of a chamber surrounding the diaphragm. Since the objective of the invention is accomplished by attenuating the sounds beyond the desired frequency and increasing the ability of the microphone to accept signals from any direction, it is essential that the microphone diaphragm be shielded from all acoustic signals except those approaching through that space.

For example, the direct acoustical signals from a source or sources, and the acoustical reverberation signals thereto caused by the interaction of the original acoustical signals and the acoustical environment, are each transduced by the microphone without discrimination with respect to their spectral content. This produces a composite electrical output signal which is an electrical analog of the acoustical signals at the position of the microphone. This means that the direct sound and the reverberant sound will exhibit the same frequency spectra, except for high frequency losses in the reverberant sound due to air and other environment absorption.

The placement of a uniform or flat pressure versus frequency type microphone with its diaphragm or major entry port substantially parallel with and proximate to a major boundary proximate and adjacent to the source, will completely remove unwanted variations in the spectra of the output signal in the selected frequency range, due to the cancellations and additions which would otherwise be caused by the interaction of the direct acoustical signal and the acoustical signal reflected from this proximate boundary without suffering the effects of pressure versus frequency variations, approaching the maximum $+6$ dB and $-\infty$ dB within the spectrum of interest, which would result from conventional microphone techniques.

In the process, the microphone is mounted with its diaphragm or major entry port substantially parallel and at a distance M from the boundary. Distance M can be determined by a formula so that the frequency, at which the first cancellation occurs, is above the highest frequency of interest. The spectrum roll-off can be accentuated by combining the first order cancellation mode with the natural high frequency roll-off of the microphone. Additionally, an electrical filter with good phase response, or group delay, characteristics may be added to the output of the microphone to remove the additions which can occur above the desired high frequency cut-off. This combination of acoustical and electrical filtering is desirable in digital systems to prevent aliasing and to prevent other deleterious effects in recording and reproducing systems.

Because this recording process combines the proper type of uniform pressure versus frequency microphone with appropriate mounting methods, a practical increase in output approaching the theoretical maximum of +6 dB due to operation of the microphone in a $2\pi$ steradian mode is obtained.

This uniform +6 dB increase within the spectrum of interest also can be seen as a +6 dB increase in the electrical signal to noise ratio over that obtained by conventional microphone techniques.

Figure 4:
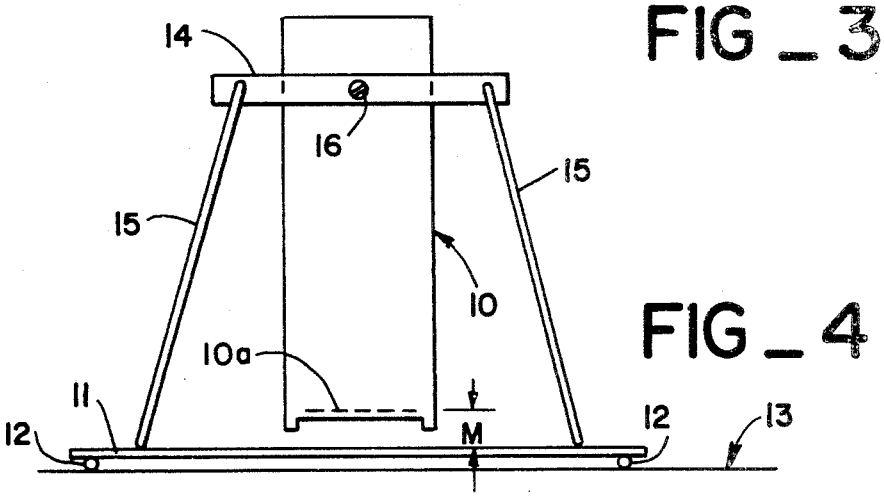
FIG. 4 is an elevation of a microphone positioned to practice the invention with its diaphragm illustrated by broken lines.

The advantages of the invention are accomplished by placing the microphone diaphragm substantially parallel and proximate to a boundary. One possible method of mounting a microphone 10 is shown in FIG. 4. There are, however, other methods of mounting which can be used to accomplish the same results. The use of the secondary, shock-mounted boundary 11 is recommended, but not absolutely necessary to accomplish the advantages of the invention. A foam foot or pad 12 can be used to isolate the boundary 11 which may be integral with the microphone, from the major boundary 13, which can be the floor. The adjustment of the spacing M of the microphone diaphragm 10*a* is accomplished by sliding the microphone 10 in the retaining collar 14 that is supported on legs 15. It is locked in place with set screw 16 at the desired spacing. The dimension M, between the microphone diaphragm 10*a* and the boundary, determines the frequency of first cancellation. This frequency can be calculated using the formula disclosed hereafter. Of course, microphones may be manufactured which have a fixed, predetermined diaphragm to boundary spacing. The secondary boundary 11 actually forms part of the major boundary in a practical sense, so long as pads 12 raise it less than $\frac{1}{4}$ of a wavelength at the highest frequency to which it is desired that the microphone system respond in a uniform manner when any of the edges of the secondary boundary are at a distance of, or less than, one wavelength of this frequency.

So long as the angle of incidence between the direct sound from a source to a point referred to the center of the diaphragm of major entry port of the microphone and the boundary proximate to the microphone is at least twice the angle between the plane of the diaphragm or major entry port of the microphone the process will achieve the proper results.

It is recommended that the microphone 10 be selected from a type that exhibits a uniform or flat pressure versus frequency characteristic through the frequency range of interest. This means that, as a transducer of acoustical to electrical signals, it should produce a uniform or flat electrical output versus frequency for a uniform flat acoustical pressure or random incident (diffuse field) acoustical signal input. A microphone exhibiting a smooth, gradual decrease in output at higher frequencies can also be used. A microphone characteristic such as this could be corrected using external electrical circuitry but the microphone diaphragm must be substantially parallel with and proximate to a major boundary. It is to be appreciated that the shock-mounted boundary 11 in reality forms part of a first order boundary 13, as long as the thickness of the pad 12 is as described in the previous paragraph. Of course, legs 15 could rest directly on a first order boundary. The spacing M, between the microphone diaphragm and a boundary, is determined by the highest frequency of interest and the frequency of the first cancellation mode can be determined by utilizing the formula shown below.

The process formula is:

$$K = 20\mathrm{Log}_{10}\left[\left[\mathrm{Cos}\,\frac{2\pi F\left(\sqrt{(S+M)^2+(D1^2)}-\sqrt{(S-M)^2+D1^2}\right)}{C}(1-A)\frac{\sqrt{(S-M)^2+(D1)^2}}{\sqrt{(S+M)^2+(D1)^2}}\right]+1\right] \quad (1)$$

where:

K = logarithmic ratio in decibels between the acoustical pressure at $T_2$ which would result without the boundary and the total resultant acoustical pressure due to the interaction of the direct and reflected acoustical pressures with the boundary present.

F = frequency of interest (which can be incremented)

S = spacing between source ($T_1$) and boundary

M = spacing between microphone ($T_2$) and boundary $D_1$ = projected distance along boundary between source ($T_1$) and microphone ($T_2$)

C is a constant, the speed of light

A = Absorption coefficient of boundary (between 0 and 1)

This may be simplified since:

$$D_2 = \sqrt{(S-M)^2+(D1^2)} \quad (2)$$

where $D_2$ = Source to mic distance for direct incidence sound.

and $$D_3 = \sqrt{(S+M)^2+(D1^2)} \quad (3)$$

where $D_3$ = Source to mic distance for 1st order reflection.

Therefore equation (1) may be reduced to $$K = 20\log_{10}\left[\left(\mathrm{Cos}\,\frac{2\pi f(D_3-D_2)}{C}(1-A)\frac{D_2}{D_3}\right)+1\right] \quad (4)$$

To further simplify:

Let $$\phi = 2\pi f(D_3-D_2)/C \quad (5)$$

where $\phi$ = the phase angle between the direct and reflected acoustical pressures.

Therefore:

$$K = 20\log_{10}\left[(\mathrm{Cos}\,\phi\,(1-A)\frac{D_2}{D_3}+1\right] \quad (6)$$

Since $$R = (\mathrm{Cos}\,\phi\,(1-A)D_2/D_3) \quad (7)$$

where R = the ratio between the direct acoustical pressure which would result without the boundary and the total resultant acoustical pressure due to the interaction of the direct and reflected acoustical pressures with the boundary present.

Therefore:

$$K=20\log_{10}(R+1) \quad (8)$$

It can be seen that equations (1), (4), (6) and (8) are various presentations of the basic formula used in determining the interaction of the transducer placement and the boundary, with respect to the highest frequency of interest.

Figure 5:
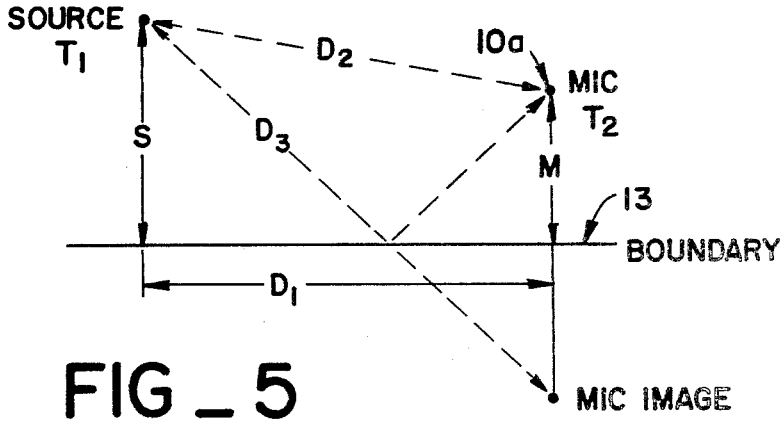
FIG. 5 is a diaphragm from which the process formula was derived.

FIG. 5 shows the geometrical model for the derivation of the process formula. The terms therein are defined as follows:

D1 is the projected distance along the boundary between the source and mic;

D2 is the source to mic distance for direct incident sound;

D3 is the source to mic distance for the first order boundary reflection;

S is the source to boundary spacing; and

M is the mic to boundary spacing.

In an article by Roger Anderson and Robert Schulein, "A Distant Miking Technique" *dB Magazine,* Vol. 5, No. 4, pp. 29–31 (April 1971) a method is described of adjusting a microphone, located at a selected distance from the source, which reduces the effects of the reflections from the floor boundary. It requires the microphone be placed very close to the floor. However, the diaphragm of the microphone is described as being perpendicular to the floor, while the current invention requires that the microphone diaphragm be substantially parallel to such a boundary. Also in an article by Lou Burroughs, *Microphones: Design and Application,* Sagamore Publishing Co., Inc., Plainview, N.Y. (1974), pp. 121–130, 178–184, on page 182, in the chapter entitled "Stage Floor Reflection Problems", therein describes a placement for a microphone close to the floor boundary to reduce the effects of the reflection from the floor boundary. Data in the article show clearly that the microphone is positioned with its diaphragm perpendicular to the boundary. In contradiction, according to this process, the microphone diaphragm or major entry port must be in a plane substantially parallel with the boundary surface. These articles also fail to mention the necessity of using a microphone which exhibits a uniform pressure versus frequency characteristic.

We claim:

1. A microphone for transducing acoustical signals without discrimination between direct and random incidence acoustical variations of the sound being transduced comprising a microphone with a diaphragm, said microphone having uniform pressure versus frequency response, said microphone being mounted in an acoustically insulated chamber having an entry port; mounting means supporting said chamber with said entry port closely spaced from and substantially parallel to a boundary.

2. The microphone of claim 1 wherein said mounting means includes means to adjust the space between said entry port and said boundary surface.

3. A process for transducing acoustical signals in a selected frequency range comprising the steps of:

(a) orienting a diaphragm of a microphone having uniform pressure versus frequency response substantially parallel with and proximate to a boundary within the field of a source of acoustical signals to be transduced;

(b) acoustically insulating said diaphragm from said acoustical signals except those signals approaching said diaphragm from said boundary;

(c) fixing the distance between said diaphragm and said boundary to cancel selected higher frequency acoustical signals from said source; and (d) transducing acoustical signals as the electrical analog from the transducer output of said microphone, whereby said microphone responds uniformly to acoustical signals arriving from any direction, substantially eliminating discrimination between the spectral content of direct and random incidence components of said acoustical signals, and does not transduce unwanted high frequency acoustical signals.

4. The process defined in claim 3 which includes the step of filtering the electrical signal from the output of the microphone to correct any deviation from flat pressure versus frequency response characteristics in the band of interest.

5. The process defined in claim 4 which includes the step of filtering the electrical signal from the output of the microphone to remove signal components above the frequency of the first cancellation to reduce the response rise above the first cancellation.

* * * * *

UNITED STATES PATENT AND TRADEMARK OFFICE

CERTIFICATE OF CORRECTION

PATENT NO. : 4,361,736

DATED : November 30, 1982

INVENTOR(S) : EDWARD M. LONG and RONALD J. WICKERSHAM

It is certified that error appears in the above-identified patent and that said Letters Patent are hereby corrected as shown below:

In column 1, line 26, delete "these" and insert---there---

In column 3, line 12, delete "resuls" and insert---results--

In column 4, line 35, delete "environment" and insert---environmental---

In column 6, line 50, delete f from the equation.

In column 6, line 24, delete "light" and insert ---sound---.

Signed and Sealed this

Fifth Day of April 1983

[SEAL]

Attest:

GERALD J. MOSSINGHOFF

Attesting Officer

Commissioner of Patents and Trademarks